United States Patent [19]

Neuberger

[11] 4,440,400

[45] Apr. 3, 1984

[54] PLAYING OR TRAINING DEVICE

[75] Inventor: Manfred Neuberger, Hockenheim, Fed. Rep. of Germany

[73] Assignee: Conpaten, Ltd., St. Helier, Channel Islands

[21] Appl. No.: 143,993

[22] Filed: Apr. 28, 1980

Related U.S. Application Data

[63] Continuation of Ser. No. 906,884, May 17, 1978, abandoned.

[30] Foreign Application Priority Data

May 21, 1977 [DE] Fed. Rep. of Germany ..... 2723092

[51] Int. Cl.[3] ..... A63B 69/22

[52] U.S. Cl. ..... 273/411; 273/58 C; 273/58 G; 273/1 B; 273/1 GC; 273/55 B; 273/1 ES; 272/76

[58] Field of Search ..... 273/55 R, 411, 58 G, 273/58 C, 1 B, 1 GC, 55 B; 272/77, 78, 76

[56] References Cited

FOREIGN PATENT DOCUMENTS

| | | | |
|---|---|---|---|
| 356215 | 7/1922 | Fed. Rep. of Germany | 272/77 |
| 380371 | 7/1922 | Fed. Rep. of Germany | 272/76 |
| 598613 | 2/1978 | U.S.S.R. | 272/76 |

*Primary Examiner*—Richard C. Pinkham
*Assistant Examiner*—T. Brown
*Attorney, Agent, or Firm*—Edwin E. Greigg

[57] ABSTRACT

A playing or training device comprises a resiliently mounted body such as a ball for receiving a hit, kick or like impact. At least two impact pressure responsive devices are mounted at spaced locations within the ball and each device is electrically connected to a respective lamp on an indicator panel. Each lamp is positioned on the panel in a location to correspond to a target that the ball would hit if the ball were impacted at the location of the impact device connected to that lamp.

14 Claims, 10 Drawing Figures

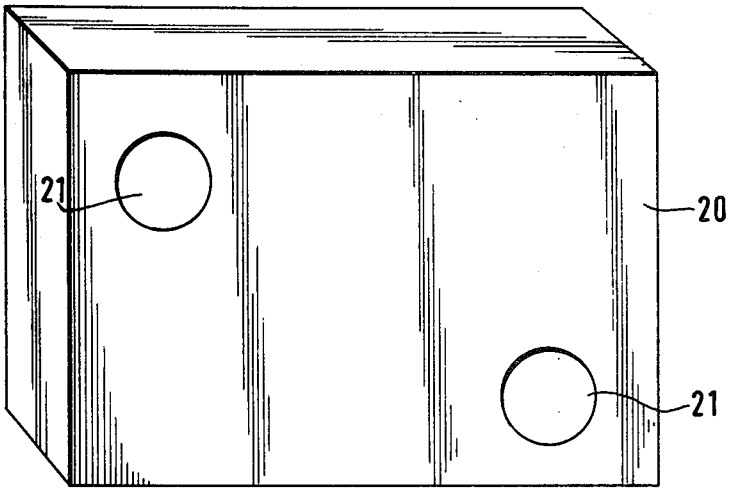
Fig. 2a
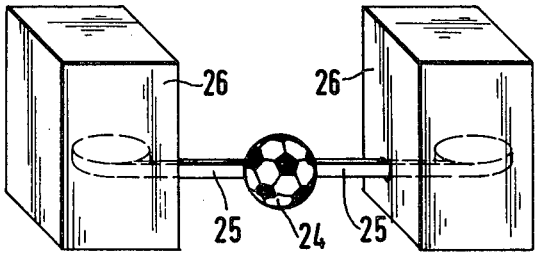
Fig. 2b
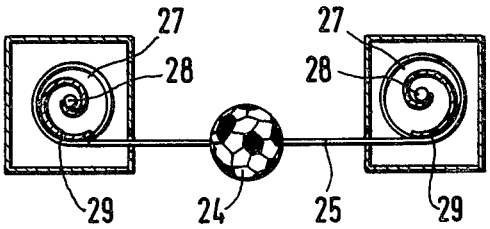

PLAYING OR TRAINING DEVICE

This is a continuation of application Ser. No. 906,884, filed May 17, 1978 (abandoned).

BACKGROUND OF THE INVENTION

This invention relates to a device for playing and/or training in which a resiliently mounted body is provided for receiving hits, kicks or like impacts.

Devices of this kind, used for training, are known for instance in the boxing field where resiliently mounted or suspended punching bags or balls are used.

SUMMARY OF THE INVENTION

It is an object of the invention to create a device for playing and/or training which permits indication of the precision with which the hits, kicks or like impacts are being made and which is designed in such a way that it can also be used inside, for example in rooms, playing halls, pubs or even private homes.

According to the invention, there is provided a playing and/or training device comprising a body for receiving a hit, kick or like impact, resilient means for mounting said body, sensing means for sensing an impact on a predetermined part of said body and indicating means responsive to said sensing means for providing an indication when said sensing means senses an impact.

BRIEF DESCRIPTION OF THE DRAWINGS

The invention will now be described in greater detail, by way of example, with reference to the drawings, in which:

FIGS. 2 and 3 show embodiments of this invention with different suspension systems for the football;

DESCRIPTION OF THE PREFERRED EMBODIMENTS

Figure 1:
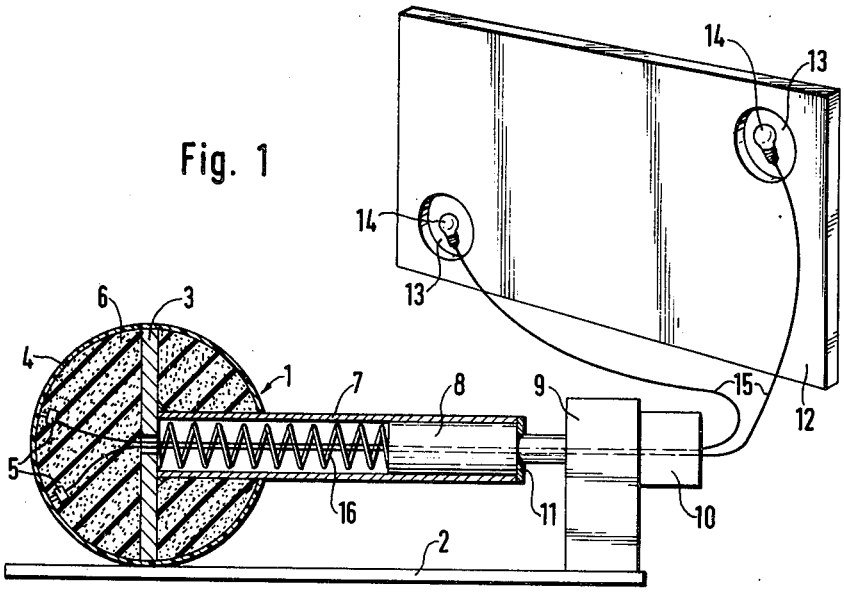
FIG. 1 shows an embodiment where the body is a football.

In a preferred form of the invention, in a playing and/or training device with a resiliently mounted body ball for receiving hits, kicks or like impacts, both of which terms may be used interchangeably at least one sensor, or at least the pressure sensitive part of a sensor, is installed in the body at a specific point to be hit. This sensor generates signals when pressure is exerted to this point. An indicator panel is provided for displaying the signals of the sensor indicating the number of hits or kicks.

The resiliently mounted body may be a ball (a football for instance), an imitation of the human or an animal body (or part of it) or any other body that can be used as an impact target.

If a body is a football (continental football or soccer) then the ball will be struck by the foot. If the body is an imitation of the human body, the impacts could be produced by the fist (boxing) or with hands and feet (karate). Blunt weapons could also be used to provide the impact, e.g. lances, swords, hockey sticks and so on. The body to be struck could then have the form of a human or animal body or a ball or whatever form would be appropriate.

By means of the sensors (or the pressure sensitive parts of the sensors) installed in the body to be kicked or hit, it can be ascertained whether a person playing or training has caused an impact to the body at specified small areas. These sensors can be electrical microswitches actuated by applied pressure on specific points of the body. Another possibility is to install small cells beneath the surface of the body, these cells being filled with a liquid or a gas, which actuates electrical switch contacts when pressure is applied to the surface under which the cell is installed. This actuation could be brought about by displacement of a flexible membrane or diaphragm. The cells can be separated into two parts: one part being installed under the surface of the body and the other part, together with the flexible membrane or diaphragm and the electrical switch contacts being installed outside the body, for example, in a switch box. The two parts would then be linked together by a small tube communicating pressure differentials between the parts;

These sensors are used to check if the body has been hit, kicked or the like at the right points or places, this being indicated optically and/or acoustically. If several sensors are installed at different areas to be hit or kicked, indications of impacts at several places on the body are possible. With a corresponding indication panel impacts at the different target areas of the body can be indicated separately and/or counted.

The resilient arrangement of the body is such that, after being displaced from its's original position by an impact, the body automatically returns to its original position. This can be realized by suspending the body between ropes, bands or other similar means that are tensioned by an elastic force which can be produced by springs and/or rubber parts. Suspension of the body with a counterweight is also possible. Another possibility is that the body be fixed to the floor, the vertical fixed part containing springs that permit a displacement of the body and/or part of it. A construction where a spring absorbs the impact directly by working in the opposite direction thereto is also possible.

Some measures can be adopted that make indication of an impact more difficult. A first possibility is to indicate the impacts only if they produce at least a certain predetermined displacement of the body and that at least a certain impact force is necessary. Another possibility to make the indication more difficult is to count the second and the following impacts only if they take place within a certain predetermined time after the preceding impact. This period of time has to be such that the body is still displaced when it is struck the next time.

Counting impacts only if they happen in a predetermined order (two targets having to be hit alternatively for instance) is another possibility to increase the difficulty of the system. A further possibility is that some targets on the body can be positioned such that they can be seen or hit only after the body is displaced; for example the chin tip of a boxer could be covered by a hand and is only freed if the body is displaced, generating a relative movement between the body and the hand. If the body represents an animal, a lowered head could hide a target that becomes visible only if the body is displaced.

Around the target sensor other sensors can be placed to indicate to the person playing or training where he really has kicked or hit. These kicks or hits can be included as they are in the results indicated or they can be provided with a reduced weighting.

Referring now to the drawings, FIG. 1 shows a section of a special ball 1 mounted on a board 2. The left half-ball comprises a plate 3, a ball surface 4 and two microswitches 5 installed in the ball. Each microswitch is actuated by a pin which is displaced by the deformed ball surface. The inner part of the ball is filled with resilient material such as rubber, foam rubber or similar suitable material, in which the two microswitches 5 are embedded at selected positions. The ball is carried by an arrangement of telescopic tubes 7 and 8. Tube 7 is fixed to the plate 3 and tube 8 is fixed to a base support 9. Between parts 3 and 8 and within the tube 7, a spring 10 is mounted such that together with step 11, it normally keeps the ball at the indicated position but permits a limited predetermined displacement of the ball. The switches 5 are connected with a circuit box 10 by wires passing through the walls of the plate 3, through the tubes 7 and 8 and the base support 9.

In behind the ball, a football goal 12 is mounted (indicated in perspective) which contains two circular targets. The lower left hand target corresponds to the microswitch 5 mounted on the right side of the ball slightly above the middle line. The target at the right hand upper corner corresponds to a microswitch mounted within the left side of the ball and slightly below the middle line.

Lamps 14 are positioned at the targets and are connected with the circuit box 10 and the microswitches 5 through the wires 15. On actuation of the microswitches 5, by an impact, the lamps are lit for a short moment and thus indicate a correct kick.

This is based on the principle that a ball has to be kicked at a particular known point in order to be sent from a given point to an indicated target 13. The microswitch 5 has to be placed at this point. This means that the microswitch indicates whether the ball has been kicked at the right point. The hit may be indicated both optically and acoustically. Since it is well known that an impact on a ball in a certain place will propel the ball in a given direction, the microswitches are placed in the ball at certain positions. The lamps 14 are then placed in a position on the indicator board at which the ball would impact if hit or kicked in the area containing the switch. Therefore, the light activated by the switch in the ball will be placed in an area of the indicator board at which the ball would strike if hit or kicked in the area of the switch. Thus the indicator board becomes the target indicator. That is, the light indicator will light up in the area of the indicator board at which the ball would impact the indicator board if the ball were to be kicked or hit in a certain area. In use, if one wishes to kick the ball to a certain target area, the kicker must strike the ball in a certain area. If the kicker kicks the ball and the indicator light for that target area does not light-up, then the kicker knows that the ball was not kicked in the correct area. Therefore the kicker learns the proper area of the ball to be kicked in order to propel the ball to a particular target area. The proper kick is indicated by the switch in the ball activating the light in the indicator board which will indicate the target area to which the ball would travel if kicked properly.

FIG. 2 shows an example in which the ball is suspended by means of two bands tensioned by two spring reels containing springs such as are used, for example, in roller blinds or shutters.

FIG. 2*a* shows a football goal 20 with two targets 21. In front of the goal, a ball 24 between columns 26 so as to just touch the floor is suspended by two bands 25. The bands are retained resiliently in the columns 26 which contain, as shown in FIG. 2*a*, the spring reels 27 rotating on the shafts 28. The bands 25 are partly wound on the reels 27.

The reels 27 contain a spring 29 fixed at one end to the reel 27 and at the other end to the shaft 28, the spring being pretensioned such that it tends to wind the band on to the reel.

If the ball 24—which contains sensors, or at least the pressure sensitive parts of sensors—is kicked it moves against the tension of the springs 29 in the direction in which it is kicked, but is brought back by the action of the springs to its starting position. The bands prevent twisting of the ball. If the ball is kicked at the places corresponding to the targets, a hit is indicated at a corresponding impact indicator 21.

Figure 3:
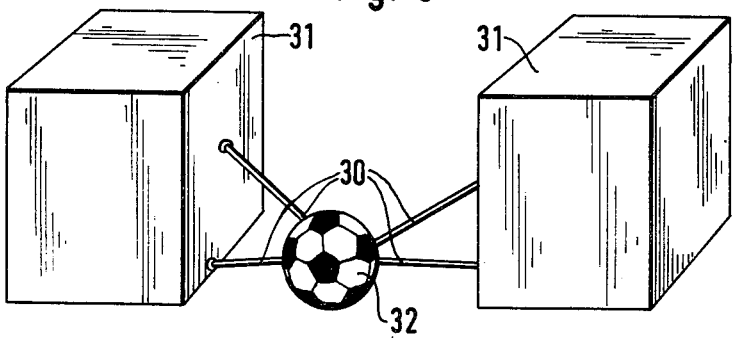
Figure 3:
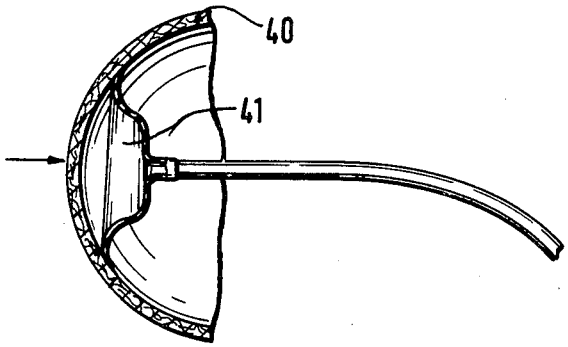

In FIG. 3, the ball 32 is held by four rubber cords 30 fixed to columns 31. Two cords are not sufficient because they cannot prevent twisting of the ball 32.

Since a flat surface can be determined by three points, the ball, in order to prevent twisting, three cords which are sprung or have rubber or elastic parts can be used for the fixing and for bringing the ball to its original position.

Figure 4:
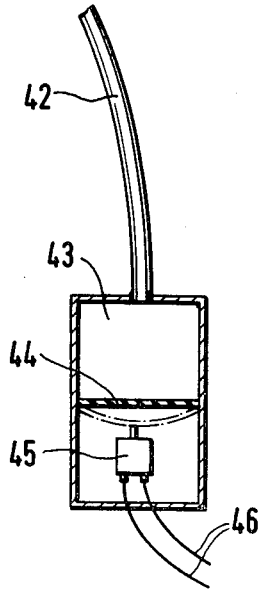
FIG. 4 shows an embodiment of a sensor that works by fluid displacement of a diaphragm.

FIG. 4 shows a small part 40 of the surface of a body to be kicked or hit. Beneath the ball surface, one part 41 of a pressure sensitive cell is shown which is connected through a flexible tube 42 with a second part 43 of the cell. This part is located outside the body. Parts 41 and 43 as well as the tube 42 contain air. If pressure is applied to part 40 of the ball surface above the cell part 41, the pressure in the system 41, 42 and 43 displaces a diaphragm 44 and actuates a switch 45. This switch generates a signal on a line 46.

Figure 5:
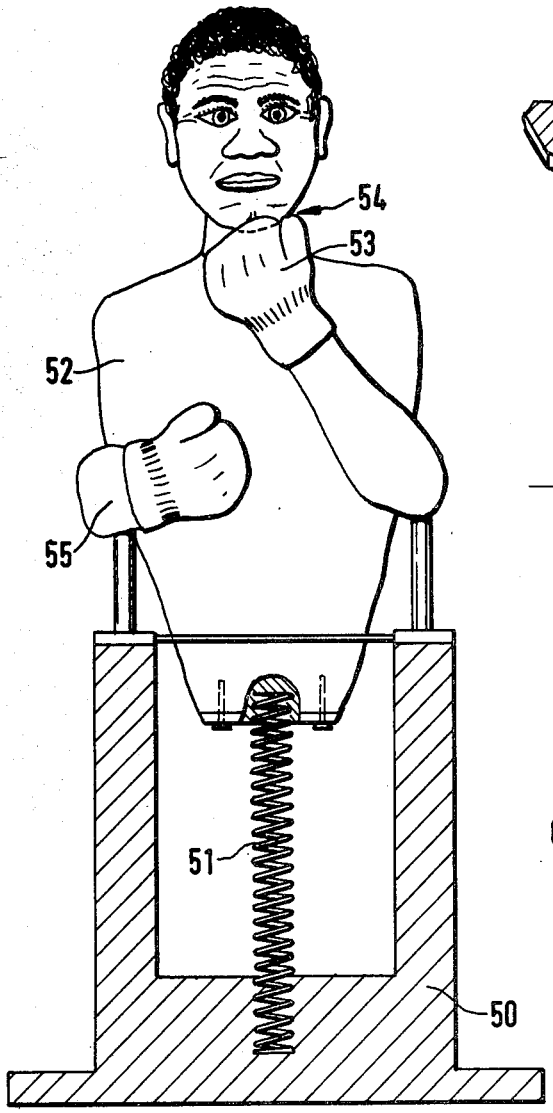
FIG. 5 shows an example where the body is a simulation of a boxer.

FIG. 5 shows a simulated boxer mounted on a vertical spring 51 fixed to a base element 50. If the body of the boxer is hit, it will be displaced. The hand 53 is fixed to the supporting base element and will not be displaced with the body. This hand 53 normally hides the tip of the chin where a sensor is placed. The sensor is only triggered if the body is displaced by a first hit. The next stroke, if it lands while the body is displaced, can hit the chin. Another part of the body could be protected by the second hand in the same way. In this example, the number of hits within a determined time could be counted. The different hits on the different targets may have different values.

Figure 6:
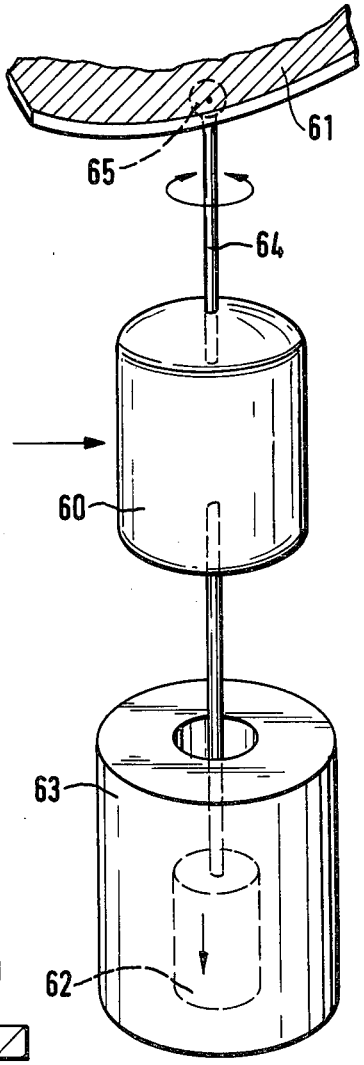
FIG. 6 shows a possible alternative suspension system.

FIG. 6 shows a suspension system where the body 60 to be struck or hit is suspended from a guide 61 by a rope 64 fixed to a spherical runner 65. A weight is fixed to the lower part of the body the freedom of movement of which is limited by a receptacle 63. If struck or hit, the body is displaced but returns to it's original position through the action of the weight and the nature of the guide 61 which has a stable equilibrium position at its lowest point.

Twisting of the body is possible at all times and this, together with the suspension system and possibility of movement of the weight in the receptacle 63 generates unpredictable and uncontrollable movements of the body that make hitting or striking of the sensor points more difficult.

Figure 7:
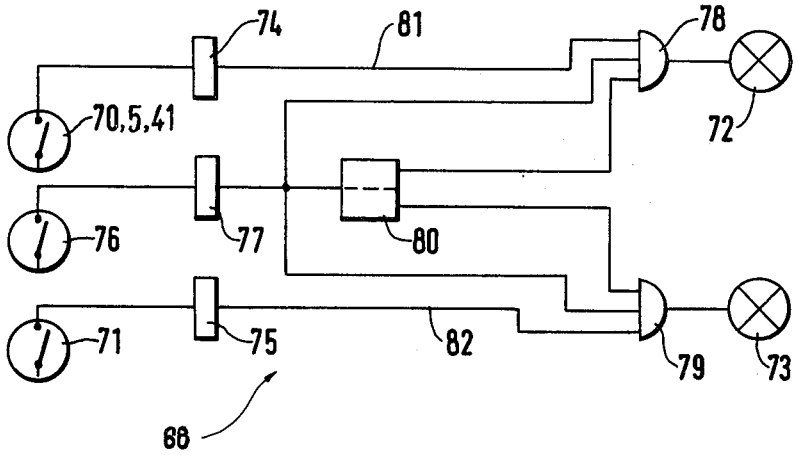
FIG. 7 shows an example of an electrical circuit for the indication of the number of kicks or hits.

FIG. 7 shows an example of an electrical circuit 68 for kick or hit indication for any of the different species shown in FIGS. 1-3, 5 and 6. Two sensors 70 and 71, located in the body, are shown and these correspond to two targets with hit indication by corresponding lamps 72 and 73. The sensors 70 and 71 are connected to monostable multivibrators 74 and 75 which produce a signal for a predetermined time if the sensors generate a signal. The resulting signal can be used to indicate hits by illumination of the corresponding lamps 72 and 73. If hits are only to be counted if the body has been struck with a certain force resulting in a predetermined displacement of the body, a further microswitch 76 is provided followed by a monostable multivibrator 77. AND-gates 78 and 79 can be installed, such that the signal of the multivibrator 77 prepares the AND-gates 78 or 79 for the signals of the switches 70 and 71. The AND-gates are connected to the respective multivibrators by lines 81 and 82. The pulses of the multivibrator 77 may also be fed to a switching circuit 80. This switching circuit 80 may control, in each of its two alternate positions, the respective AND-gates 78 and 79 so that a hit is only indicated, if the target hit corresponds to the position of the circuit 80. To score with this system it is necessary to hit the targets alternatively.

Figure 8:
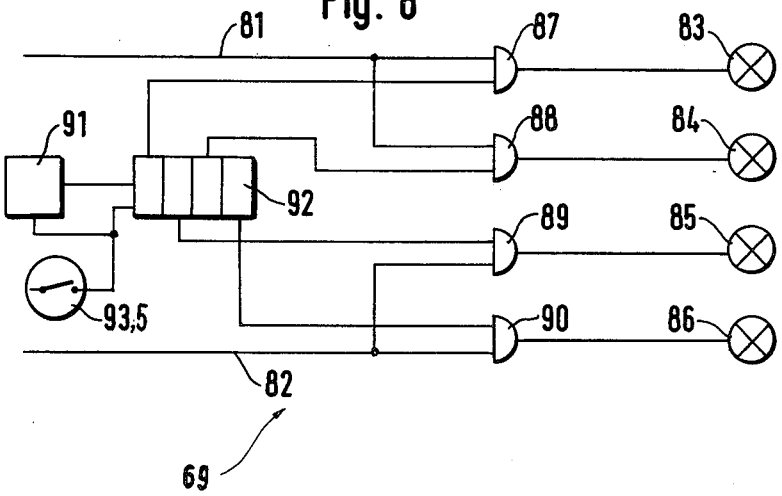
FIG. 8 shows another embodiment of the circuit of FIG. 7.

FIG. 8 shows an evaluator circuit 69 having the lines 81 and 82 indicated as shown in FIG. 7 which are connected to the sensors 70 and 71 via the monostable multivibrators 74 and 75.

In this example, four lamps 83 to 86 are provided as well as four AND-gates 87 to 90, a timer 91 a counter 92 and a starting switch 93. If the switch 93 is actuated, the timer 91 is started and the counter 92 is set to starting position. In this position the counter generates a signal which is fed to AND-gate 87. This has the effect that only a signal on line 81 will provide a hit indication by illuminating the lamp 83. After a predetermined time (2 seconds for instance) the timer 91 produces a signal which advances the counter 92 by one step.

The counter now prepares AND-gate 89 and, for the next two seconds, and a hit indication, corresponding to a signal from sensor 71 can be provided by lamp 85. The counter is advanced successively by the timer and prepares the AND-gates 88 and 90 in sequence, these AND-gates being associated with sensors 70 and 71 respectively. In this system, only hits applied alternatively to the two targets and within a predetermined period, are indicated.

Figure 9:
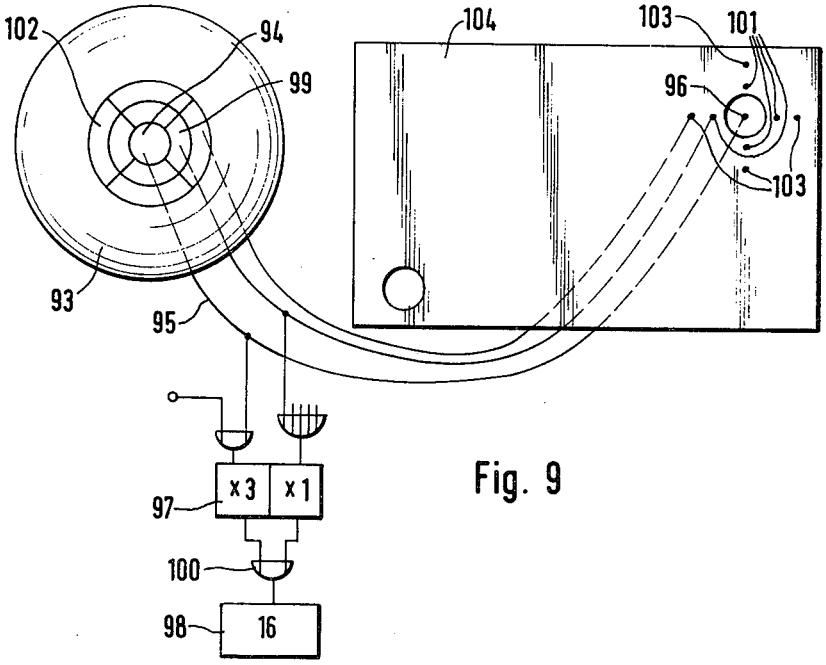
FIG. 9 is a block diagram of a circuit for determining counting and displaying the number of kicks or hits.

In FIG. 9 a football is indicated at 93. Under the surface zone 94 of this ball, which in practice is not supported as shown, a direct kick or hit, or main sensor is arranged. A line 95 coming from this sensor leads to the indicator lamp 96 within a target panel or goal 104, both shown only schematically. This lamp 96 here indicates direct kicks. The sensor is further connected to a control circuit 97,-which controls the signal on line 95, indicating a direct kick, for example by the factor 3. This may be done by generating three output pulses if one input pulse occurs. The output of the circuit 97 is then fed via OR-gate 100 to the counter 98 which counts and displays the result. If the ball 93 is struck at one of the four zones 99 bordering on zone 94, each containing a sensor, the corresponding lamp is switched on via the lines between these sensors and the lamps 101 (only one of these lines is shown) indicating that the kick has been applied a bit too high, or too low, or to one side (left or right) of the target. Such kicks applied to the zones 99 near the target, may also be fed to the control circuit 97 and may there be indicated with a factor 1; thereupon the pulse is fed to counter 98 which may have an output drive to an acoustic indicator as is known in the art of pin ball machine systems.

Kicks lying further from the zone 94 and in zones 102 may also be recognized by four sensors being assigned to these zones and being connected to lamps 103 (only one line is shown); the lamps show where a kick has landed on the ball.

The kicks on a second target may be controled in a separate control circuit 97 and be counted in a separate counter 98 (not shown).

The playing arrangement according to the invention may be used by one person or by several persons in competition, playing one against the other or one group against another group.

This playing arrangement may also be used in public and may be actuated by a coin release mechanism.

It will be understood that the above description of the present invention is susceptible to various modification changes and adaptations.

What is claimed is:

1. A playing and/or training device which indicates a precision with which desired impacts by a player on a ball may be designated, comprising a ball to be impacted, at least two impact pressure sensing means within said ball for sensing impacts directed onto at least two predetermined areas of the surface of said ball, indicating means responsive to an impact on the area of said ball containing said sensing means for providing an indication when the said sensing means senses an impact, resilient means for supporting said ball between two lateral support means, each impact pressure sensing means comprising a switch contact actuated by a pressure acting on said switch contact because of an impact in an area in which said switch control is placed, said indicating means comprising lamps, each lamp being connectible to an electric source by one of said switch contacts when the ball surface is impacted at the predetermined area assigned to said lamp, a target indicator panel, said target indicator panel including said lamps which are positioned relative thereto for visual observation by the player whereby each lamp is topographically arranged within the target indicator panel to represent a target which said ball will hit if impacted at the corresponding predetermined area of its surface to activate a sensing means.

2. A device as defined in claim 1 and comprising tensioning means for tensioning said ball in a plane perpendicular to a direction approximating its deflection under impact.

3. A device as defined in claim 1 wherein said tensioning means comprises supporting means having parts providing a spring action.

4. A device as defined in claim 3 wherein said supporting means comprise rubber-like resilient material.

5. A device as defined in claim 3 and comprising springs connected to said supporting means.

6. A device as defined in claim 3 and comprising reels for receiving said supporting means and spiral springs acting on said reels in a direction to wind up said supporting means.

7. A device as defined in claim 1 and comprising at least one additional switch which responds only on a ball deflection of a predetermined amount and an evaluation circuit for preventing an impact indication until response of said additional switch takes place.

8. A device as defined in claim 1 and comprising switching means for allocating different values to impacts at different positions on said ball and an evaluation circuit for scoring the impacts by addition of their said values.

9. A device as defined in claim 1 and comprising an evaluation circuit for preventing indication of impacts unless said impacts take place on parts of said ball in a predetermined sequence.

10. A device as defined in claim 1 and comprising an evaluation circuit having a timing element for preventing indication of impacts unless they occur in predetermined times determined by said timing element.

11. A device as defined in claim 1 and comprising several lamps for indicating impacts which have been achieved in succession.

12. A device as defined in claim 1 wherein said indicating means comprises an acoustic indicator.

13. A device as defined in claim 1 and comprising additional sensing means for sensing impacts at other parts of said body than said predetermined parts and indicating means responsive to said additional sensing means for indicating that said predetermined parts have been missed by the impact.

14. A device as defined in claim 1 in which said sensors are divided and one part is a cell arranged within the ball and is assigned to one of the predetermined parts of the ball surface and a second part together with a membrane and a switch contact is arranged outside the ball, the two parts being connected by a hose connection.

* * * * *